United States Patent [19]

Bergstein

[11] 4,286,806

[45] Sep. 1, 1981

[54] ROLLER SKATING SPARK GENERATOR

[76] Inventor: David Bergstein, R.R. 3 Indian Hill Rd., Pound Ridge, N.Y. 10576

[21] Appl. No.: 127,923

[22] Filed: Mar. 6, 1980

[51] Int. Cl.[3] ..... A63C 17/26

[52] U.S. Cl. ..... 280/816; 46/10

[58] Field of Search ..... 280/11.19, 11.2, 816; 46/10, 48; 431/273, 274

[56] References Cited

U.S. PATENT DOCUMENTS

| | | | |
|---|---|---|---|
| 1,790,423 | 1/1931 | Hooks | 280/816 X |
| 3,086,788 | 4/1963 | Vislocky | 280/816 |

FOREIGN PATENT DOCUMENTS

| | | | |
|---|---|---|---|
| 366115 | 1/1932 | United Kingdom | 46/10 |
| 370227 | 4/1932 | United Kingdom | 46/10 |

*Primary Examiner*—Joseph F. Peters, Jr.
*Assistant Examiner*—Michael Mar
*Attorney, Agent, or Firm*—Nathaniel Altman

[57] ABSTRACT

A spark-generating mechanism for mounting on, and for use in combination with, a roller skate or roller skateboard. The mechanism includes a support bracket adapted to be attached to the skating device, to carry rotatably a grindstone wheel between two larger actuating wheels and to hold a spark producing element in resilient contact with the grindstone wheel. Positioned to be inoperative during normal skating, the spark-generating mechanism may be actuated at will by the skater's slightly backward tilting of the roller skating device while in motion.

4 Claims, 6 Drawing Figures

ROLLER SKATING SPARK GENERATOR

BACKGROUND OF THE INVENTION

Spark-generating devices are of course an old art, as the almost universal use of cigarette lighters will attest. Non-igniting sparking units have been used in toys for years; two relatively recently issued patents involving this type are: U.S. Pat. No. 3,377,739, Apr. 18, 1968 on "Sparkling Spinner" (Michelman), and U.S. Pat. No. 3,435,554, Apr. 11, 1969 on "Sparking Hammer" (Phillips). In contrast, the concepts of the combination of a spark-generating mechanism with a roller skate or skateboard, and of using the rotational motion of the skate selectively to produce sparking when desired, have not previously been disclosed. The primary object of this invention is to apply these novel concepts by providing a spark-generating mechanism as an attachment for, in combination with, and operated by a roller skate or the like. With this mechanism, the roller skater may enhance his enjoyment and dramatically punctuate his skating maneuvers with sparking effects at will.

SUMMARY OF THE INVENTION

The spark-generating mechanism of this invention includes a support bracket adapted to be held in place by the existing screw on the rear wheel assembly of a conventional roller skating device. At the rear end of the support bracket an axle, fixedly carrying a grindstone wheel between two actuating wheels, is mounted for free rotation. The support bracket also holds a spark-producing steel button or flint in resilient contact with the grindstone wheel.

The entire spark-generating mechanism is positioned on the roller skate so that it does not operate during normal skating; at the skater's will, however, by his tilting the skating device slightly rearwardly, the actuating wheels are brought into contact with the surface on which the skate or skateboard is moving, causing the actuating wheels, and hence the axle and grindstone wheel, all to rotate in unison with the skate wheels. Sparks are generated from the frictional engagement and rubbing of the grindstone in rotation against the spark-producing element continuously until the skater lifts the actuating wheels out of contact with the skating surface by straightening his skate.

The invention will now be described in fuller detail in clear and precise terms, and the best mode now contemplated for practising it will be indicated, all in connection with the drawings which accompany this disclosure, in which:

SHORT DESCRIPTION OF DRAWINGS

DESCRIPTION OF PREFERRED EMBODIMENTS

Figure 1:
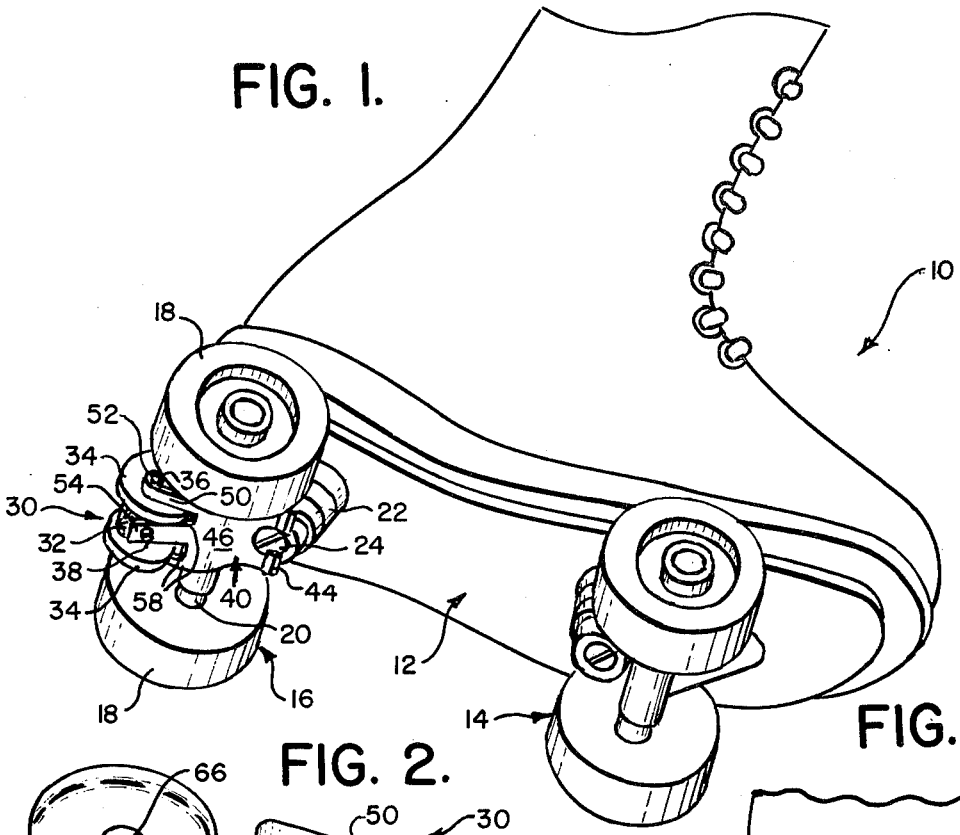
FIG. 1 is a bottom perspective view of a conventional roller skate with a preferred embodiment of the spark-generating mechanism of this invention attached.

FIGS. 1–5 illustrate a preferred form of the spark-generating mechanism of this invention mounted on a conventional roller skate, generally designated 10. Roller skate 10 includes sole-plate 12, which carries front wheel assembly 14 and rear wheel assembly 16, with rear wheels 18 on axle 20 rotatably held by rear wheel support 22. Screw 24 on wheel support 22 serves as the attachment means for holding the inventive spark-generating device generally designated 30 in place.

Figure 2:
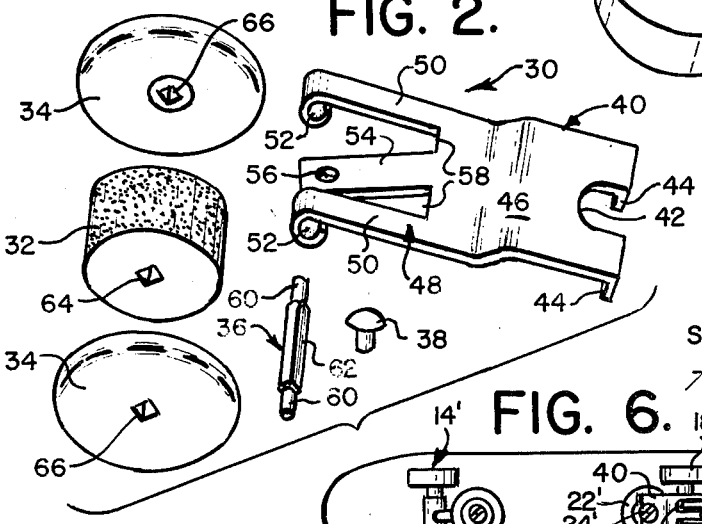
FIG. 2 is an exploded perspective view of the principal elements of the spark-generating mechanism of FIG. 1.
Figure 3:
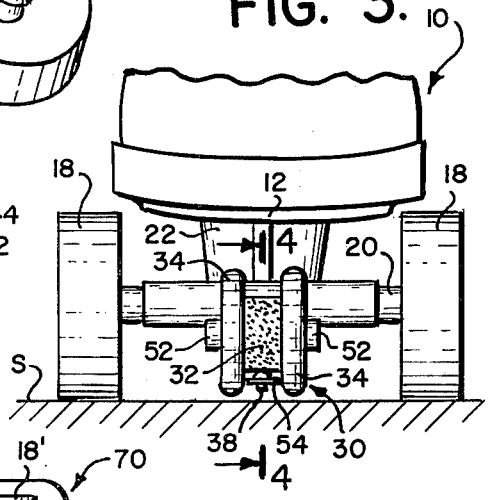
FIG. 3 is a partial rear view of the roller-skate, spark-generatator combination of FIG. 1.

As best seen in FIG. 2, spark-generating mechanism 30 comprises a grindstone wheel 32 and two actuating wheels 34, an axle 36 on which wheels 32 and 34 are to be fixedly mounted, a spark-producing steel button 38, and bracket support means 40 for mounting on skate 10 and for holding the elements of spark-generator 30 in assembled relationship as hereinafter described.

Figure 4:
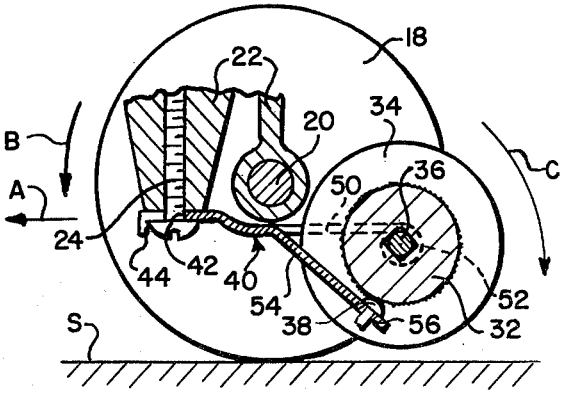
FIG. 4 is a fragmentary sectional view taken along line 4—4 of FIG. 3, showing the skate in normal position and the spark-generating mechanism inoperative.
Figure 5:
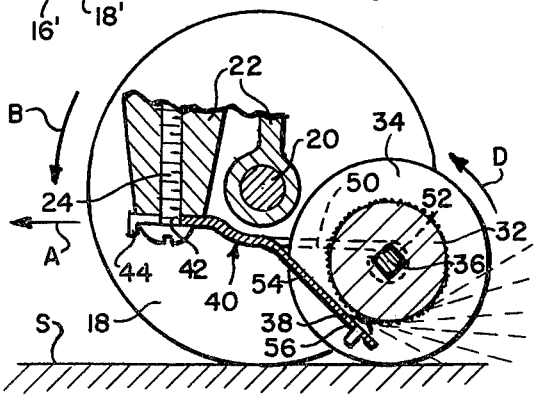
FIG. 5 is a fragmentary sectional view similar to FIG. 4, but with the skate tilted slightly rearwardly and the spark-generating mechanism in operative position and creating a sparking effect.

At its forward end, bracket support means 40, in its preferred form, has a centrally disposed notch 42, generally semicircular in shape for close engagement with the shank of skate screw 24 when mechanism 30 is attached to skate 10 (see FIGS. 4 and 5). On either side of notch 42, bracket 40 carries downwardly projecting flanges 44 for engagement with the head of screw 24 for locking assembled mechanism 30 in place on skate 10. Body portion 46 of bracket 40 is curved as shown to fit around skate axle 20 and extends rearwardly to trifurcated end portion 48. The two outer projections 50 of bracket 40 terminate in rolled ends 52, which serve as journals to hold rotatably the ends of axle 36; central projection 54 is angled downwardly from the main body 46 of bracket 40, and is provided with bore 56 into which spark-producing button 38 fits. The cut-out areas 58 between projections 50, 54 allow space for actuating wheels 34 to turn freely when mechanism 30 is assembled. Bracket support means 40 is preferably fabricated from spring steel, but it is contemplated that other metals or plastics of sufficient strength and resiliency may be substituted.

When assembled, spark generator 30 has grindstone wheel 32 centrally disposed on axle 36, flanked by actuating wheels 34, with the ends 60 of axle 36 mounted for free rotation in journals 52. As best seen in FIG. 2, the center portion 62 of axle 36 is, in the preferred embodiment, of square cross-section; wheels 32 and 34 have square-shaped openings 64 and 66, respectively, complementary to axle portion 62, so that all wheels must rotate with axle 36. Other methods of locking wheels 32, 34 on axle 36, such as keying, may replace the square axle, and conventional means such as lock washers or swedging the axle (not shown), may be used to keep the wheels from lateral shifting.

Grindstone wheel 32 may be identical in composition and character to those conventionally used in cigarette lighters and the like; flanking actuating wheels 34 are preferably formed of hard rubber or similar materials and are of sufficiently large diameter to protect the grinding surface of wheel 32 from any contact other than with spark-producing element 38 held resiliently in contact with grindstone 32's peripheral surface by center projection 54 of bracket means 40. Spark-producing element 38 is shown in its preferred form as a steel button, advantageously providing a long-wearing spark source, but may be readily replaced by conventional flints, if desired.

Figure 6:
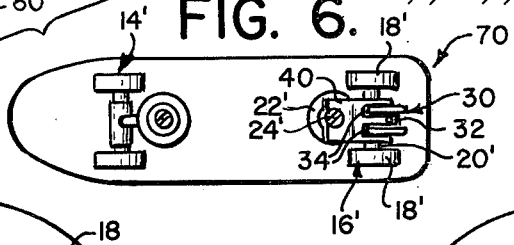
FIG. 6 is a bottom plan view of a skateboard to which a spark-generating mechanism has been attached.

FIG. 6 illustrates the attachment of spark generator 30 to a skateboard 70, which has front wheel assembly 14, rear wheel assembly 16; rear wheels 18' on axle 20' and screw 24' on rear wheel support 22'. In all respects, the combination of skateboard 60 with spark generator 30 is comparable to the skate 10-spark generator 30 combination.

ATTACHMENT AND OPERATION OF SPARK GENERATOR

Attaching spark-generating mechanism 30 involves simply loosening screw 24 (or 24') of rear skate wheel support 22 (or 22'), placing mechanism 30 in position so that notch 42 in bracket support means 40 is in close engagement with the shank of screw 24, which is then retightened.

The operation of spark generator 30 is clearly shown in FIGS. 4 and 5. The normal skating position of FIG. 4 has roller skate 10 moving forward (arrow A) with its wheels rotating in the direction of arrow B. Spark generator 10 is now inoperative with actuating wheels 34 out of contact with roller skating surface S. Slight rearward tilting of skate 10 in the direction of arrow C, however, brings about the position of FIG. 5. Actuating wheels 34 are now in contact with surface S, skate 10 still moving in the direction of arrow A, its wheels rotating according to arrow B, simultaneously turning actuating wheels 34 as indicated by arrow D. This causes grindstone wheel 32 to rotate frictionally in resilient contact with spark-producing element 38 creating a sparking effect as long as actuating wheels 34 remain in contact with surface S.

The preferred embodiments of this invention have been fully described, with various modifications suggested and contemplated; the scope of the invention is defined only by the appended claims.

I claim:

1. In combination with a conventional roller skating device having a screw in its wheel support structure, a spark-generating mechanism which comprises:

an axle;

a grindstone wheel, centrally and fixedly mounted on said axle;

a pair of actuating wheels of a diameter larger than the diameter of said grindstone wheel, said actuating wheels being fixedly mounted on said axle on either side of said grindstone wheel;

a spark-producing element held resiliently in contact with the peripheral end surface of said grindstone wheel; and bracket support means for journalling the ends of said axle for free rotation, for holding said spark-producing element against said grindstone wheel, and for attaching the entire spark-generating mechanism with the screw of the wheel support structure of the roller skating device.

2. Spark-generating mechanism in accordance with claim 1, wherein said spark-producing element is a steel button.

3. Spark-generating mechanism in accordance with claim 1, wherein said spark-producing element is a flint.

4. Spark-generating mechanism in accordance with claim 1, said bracket support means having a notch, substantially semi-circular in shape and centrally disposed at one end of said bracket support means, for accomodating and engaging in the shank of the screw in the wheel support structure of the roller skating device; said bracket support means also comprising:

a pair of depending flanges, immediately adjacent to and flanking said notch, for locking engagement with the head of the screw in the wheel support structure of the roller skating device; and the end of said bracket support means opposite said pair of depending flanges being of trifurcated configuration, each of the two outer projections being rolled over at its end to form a journal for mounting one end of said axle for free rotation, the center projection being angled downwardly with respect to the plane of said bracket support means and having a bore near its free end for holding said spark-producing element in resilient frictional contact with said grindstone wheel.

* * * * *